US008286808B1

(12) United States Patent
Setlik

(10) Patent No.: US 8,286,808 B1
(45) Date of Patent: Oct. 16, 2012

(54) WALL MOUNTED VERTICAL FILE FOLDER RACK

(76) Inventor: Steve Setlik, Denver, CO (US)

( * ) Notice: Subject to any disclaimer, the term of this patent is extended or adjusted under 35 U.S.C. 154(b) by 553 days.

(21) Appl. No.: 12/583,483

(22) Filed: Aug. 21, 2009

Related U.S. Application Data

(63) Continuation-in-part of application No. 11/369,691, filed on Mar. 6, 2006, now abandoned.

(51) Int. Cl.
*A47H 1/00* (2006.01)

(52) U.S. Cl. ..... 211/96; 211/184; 211/45; 211/11; 211/55; 211/106.01; 248/289.11

(58) Field of Classification Search ..... 211/10, 211/11, 12, 41.5, 47, 48, 50, 52, 55, 85.15, 211/85.17, 85.26, 85.31, 87.01, 96, 100, 211/106, 119, 184, 181.1, 103, 106.01; 248/289.11, 248/290.1
See application file for complete search history.

(56) References Cited

U.S. PATENT DOCUMENTS

| | | | | | |
|---|---|---|---|---|---|
| 238,117 | A | * | 2/1881 | Hillman | 211/45 |
| 451,729 | A | * | 5/1891 | Dom | 211/11 |
| 500,879 | A | * | 7/1893 | Frankel | 211/119 |
| 863,114 | A | * | 8/1907 | Stevens | 248/451 |
| 928,195 | A | * | 7/1909 | Henderson | 211/119 |
| 1,525,445 | A | * | 2/1925 | Hamilton | 211/50 |
| 1,710,826 | A | * | 4/1929 | Holbrook | 248/175 |
| 2,109,713 | A | * | 3/1938 | Schroeder | 211/11 |
| 2,221,659 | A | * | 11/1940 | Wilkie | 211/119 |
| 2,433,247 | A | * | 12/1947 | Stowell | 211/100 |
| D162,397 | S | * | 3/1951 | Fink | D6/463 |
| 2,633,994 | A | * | 4/1953 | Brown | 211/41.11 |
| 2,640,598 | A | * | 6/1953 | Peacock | 211/89.01 |
| 3,176,849 | A | * | 4/1965 | Peebles | 211/50 |
| 3,534,863 | A | * | 10/1970 | Howard | 211/47 |
| 4,049,127 | A | | 9/1977 | Alexander | |
| D349,131 | S | | 7/1994 | Nystrom et al. | |
| 5,344,030 | A | * | 9/1994 | Evenson | 211/55 |
| 6,161,704 | A | | 12/2000 | Stravitz | |
| D452,976 | S | * | 1/2002 | Carpenter | D19/90 |
| 6,431,375 | B2 | * | 8/2002 | Spencer | 211/106 |
| D495,007 | S | | 8/2004 | Stravitz | |
| 2004/0099626 | A1 | * | 5/2004 | Belt | 211/113 |
| 2005/0133468 | A1 | * | 6/2005 | Stravitz | 211/11 |
| 2007/0199908 | A1 | * | 8/2007 | Kasden et al. | 211/41.5 |
| 2008/0105631 | A1 | * | 5/2008 | Sutter | 211/10 |
| 2011/0204008 | A1 | * | 8/2011 | Schulman | 211/55 |

* cited by examiner

*Primary Examiner* — Teri P. Luu
*Assistant Examiner* — Devin Barnett
(74) *Attorney, Agent, or Firm* — Edwin H. Crabtree; Ramon L. Pizarro

(57) ABSTRACT

A vertical file folder rack adapted for mounting on a wall and holding various sizes and shapes of files, posters, drawings and like items. The vertical file folder rack includes a plurality of triangular-shaped wire frames mounted and equally spaced along a length of a rectangular shaped elongated wall base. The wall base is adapted for vertical attachment to a wall. A top portion of each wire frame is pivotally attached along the vertical length of the wall base. A center portion of the wire frame includes a pair of support arms, which extend downwardly and vertically. A lower portion of the wire frame includes a pair of outwardly extending file support arms with an upwardly extending arch-shaped file keeper disposed between the two support arms. A file is received on top of the support arms and held therein between the file keeper and the two support arms.

8 Claims, 3 Drawing Sheets

WALL MOUNTED VERTICAL FILE FOLDER RACK

This application is a continuation-in-part patent application and claims the benefit of an earlier filed non-provisional patent application filed on Mar. 6, 2006 now abandoned, Ser. No. 11/369,691, by the subject inventor, and having the same title.

BACKGROUND OF THE INVENTION (a) Field of the Invention

This invention relates to a file folder rack for holding a plurality of file folders and more particularly, but not by way of limitation, to a vertical file folder rack for mounting on a wall and holding various sizes and shapes of files.

(b) Discussion of Prior Art

In U.S. Pat. No. 5,344,030 to Evenson, an expandable modular wall file having identical pockets is disclosed. The pockets are placed one on top of the other and secured to a side of a wall for receiving files and the like therein. In U.S. Pat. D452,976 to Carpenter, a design of a panel wall organizer is illustrated for attaching to a wall. In U.S. Pat. D349,131 to Nystrom et al., stackable trays are shown adapted for mounting on a wall. In U.S. Pat. No. 6,161,704 to Stravitz, a file folder rack is illustrated having recesses at different heights for receiving files. In U.S. Pat. D495,007 to Stravitz, a multilevel sorter is described attached to a wall for holding files at different heights. In U.S. Pat. No. 4,049,127 to Alexander, a hanging file folder with support frame is described. This patent is an example of many issued patents related to hanging file folders for file drawers.

None of the above mentioned patents disclose or teach the unique features, objects and advantages of the subject vertical file folder rack as described herein.

SUMMARY OF THE INVENTION

In view of the foregoing, it is a primary objective of the subject invention to provide a compact file folder rack for holding a plurality of files spaced apart and next to each other. The file folder rack is adapted for mounting vertically on a wall.

Another object of the invention is the vertical file folder rack can be easily installed on a wall and attached to a wall stud. The rack can include any number of triangular shaped wire frames spaced along a length of a wall base and disposed one on top of another. A single size of wire frames can be used for hold various sizes and shapes of file folders for easy access to each file. Also, because the wire frames can come in different lengths and have an open top and open sides, the frames can hold different sizes of drawings, posters and the like besides standard size file folders.

Yet another object of the invention is the file folder rack can be used in a business office, a home office and other rooms where spaces is limited for storing file folders. The subject file folder rack is far less expensive and takes up less room space when compared to standard two, three and four drawer file cabinets.

A further object and a key object of the invention is a lower front portion of each folder stored on the wire frames is always visible for ease in viewing file folder labels thereon and the file labels are never completely obscured by adjacent files regardless of the file size.

The vertical file folder rack includes a plurality of triangular shaped wire frames mounted and equally spaced along a length of a rectangular shaped elongated wall base. The wall base is adapted for vertical attachment to a wall. A top portion of each wire frame is pivotally attached along the vertical length of the wall base. A center portion of the wire frame includes a pair of support arms, which extend downwardly and vertically. A lower portion of the wire frame includes a pair of outwardly extending file support arms with an upwardly extending file keeper disposed between the two support arms. A file is received on top of the support arms and held therein between the file keeper and the two support arms.

In operation, a first file folder is received on top of the two file support arms of a first wire frame. The file keeper holds the first file folder in place next to the support arms of the first wire frame. When filing a second file folder, the first wire frame is pivoted upwardly and outwardly using the pivotally attached top portion of the first wire frame. A second file folder is then received on top of the two file support arms of a second wire frame. The file keeper of the second wire frame holds the second file folder in place next to the support arms of the second wire frame. When the second file folder is in place, the first wire frame and first file folder are lowered downwardly with the first file folder disposed in front of the second file folder and holding the second file folder in place on the file folder rack.

These and other objects of the present invention will become apparent to those familiar with file folder cabinets, file folder racks and the like when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the invention, and in which.

DETAILED DESCRIPTION OF THE PREFERRED EMBODIMENTS

Figure 1:
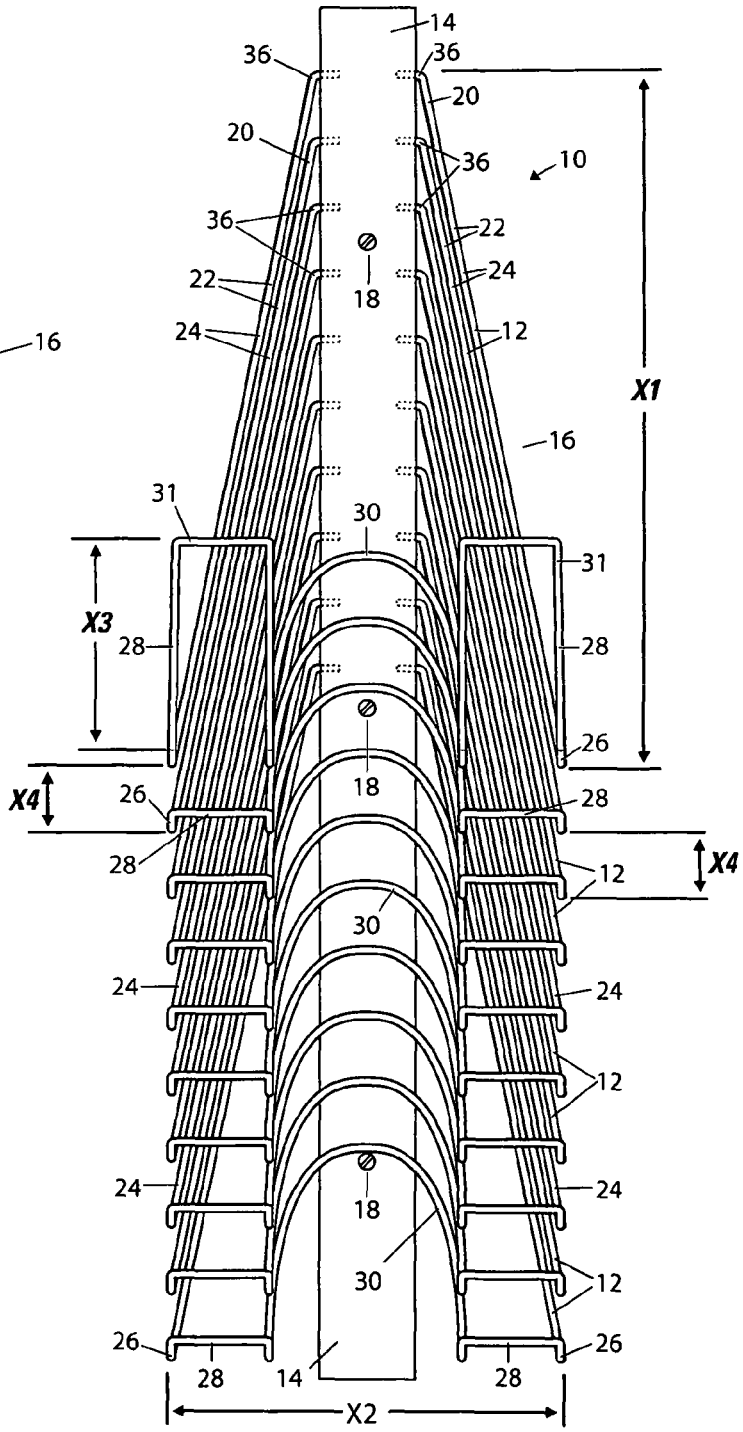
FIG. 1 is a front view of the subject wall mounted vertical file folder rack with a plurality of triangular shaped wire frames pivotally mounted and spaced apart along a length of a wall base. The wall base is adapted for mounting on a wall. The wire frames are shown prior to receiving file folders thereon.

In FIG. 1, a front view of the subject wall mounted vertical file folder rack is illustrated and having a general reference numeral 10. The file folder rack 10 includes a plurality of triangular shaped wire frames 12. The frames 12 are equally spaced apart and staggered downwardly along a length of a rectangular shaped elongated wall base 14. The wall base 14 is adapted for vertical attachment to a wall 16. The wall base 14 can be attached using threaded screws 18 or other types of fasteners to a wall stud, wall panel, sheet rock and the like.

A top portion 20 of each wire frame 12 is pivotally attached along the vertical length of the wall base 14. A center portion 22 of the wire frame 12 includes a pair of downwardly extending suspension arms 24. The suspension arms 24 can be various lengths for accommodating different sizes of files, such as a standard size file folder having dimensions of 12 inches wide by 9 inches high and a legal size file folder having dimensions of 15 inches wide by 9 inches high. These dimension are shown as "X5" and "X6" in FIG. 3. Also, drawings, posters and maps can be filed on the wire frames 12 with larger dimensions, for example, of 30 inches high, as shown as "X7" and "X8" with various widths from 12 to 36 inches and greater. Also by the design of the wire frames 12, they are open on the sides for easy accommodation of different width size items received therein.

A lower portion 26 of each of the wire frames 12 includes a pair of outwardly extending file support arms 28 with an upwardly extending arch-shaped file keeper 30 disposed between the two support arms 28 and attached thereto. It should be mentioned that the lower portion 26 of the wire frame 12 can be formed into various geometric configurations for holding a file thereon.

In FIG. 1, a top or first wire frame 12 has support arms 28 curved outwardly for holding a bottom of a first file folder thereon and then curved upwardly into a pair of inverted "U" shaped brackets 31 for holding the first file folder thereagainst. A side profile of the first wire frame 12 and one of the brackets 31 can be seen in FIG. 4. It's important to note that a different design of a first wire frame 12 is necessary to hold the first file folder thereon and prevent the first file folder from falling forward and off the front of the file folder rack 10, since there is no wire frame above it or in front of it to provide weight and pressure for holding it in place.

Figure 3:
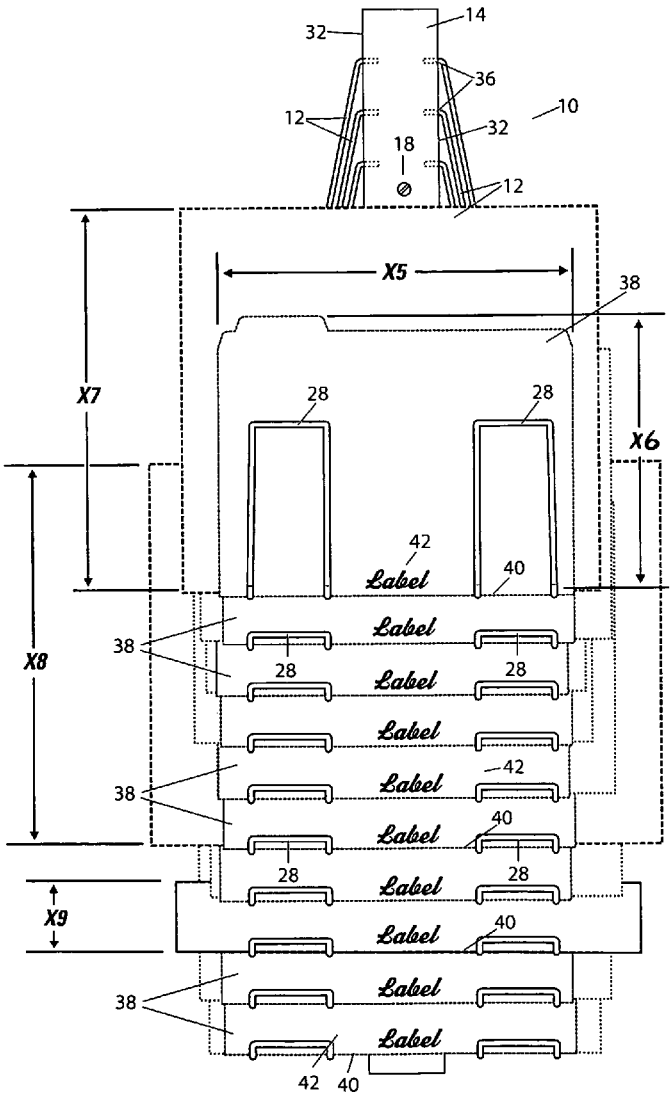
FIG. 3 is a front view of the file folder rack with a plurality of file folders received on each of the triangular shaped wire frames and disposed in a spaced relationship along the length of the wall base.
Figure 4:
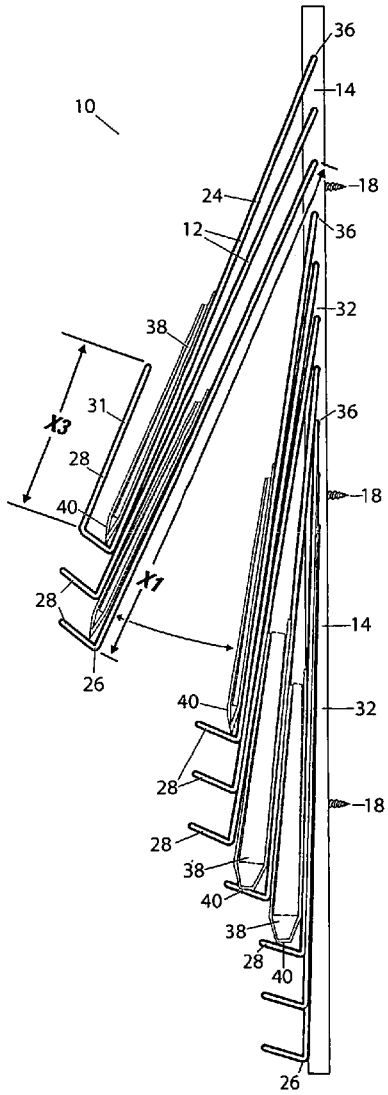
FIG. 4 is a side view of the file folder rack with stored file folders as shown in FIG. 3.

A second wire frame 12 and lower wire frames 12 are pivotally attached and spaced apart downwardly along the length of the wall base 14. These wire frames 12 have support arms 28 curved outwardly for receiving the bottom of the a file folder thereon with the arch-shaped file keeper 30 attached therebetween. The second wire frame 12 and the lower wire frames 12 don't include the inverted "U" shaped brackets 31 since other than the first wire frame 12, the lower frame second wire frame 12 and additional wire frames 12 rest against and on top of the each other in a spaced apart, staggered relationship, as shown in FIGS. 3 and 4. The file keeper 30 is used to hold the file next to the suspension arms 24. As mentioned above, the configuration of the wire frames 12 as shown allow the vertical file folder rack 10 to hold various sizes and shapes of files, drawings, posters, maps, etc.

In this drawing, a length of the suspension arms 24, from the top portion 20 down to the lower portion 26 of the wire frames 12, is shown as "X1". The length "X1" can be in a range of 12 to 36 inches and greater depending on the size of the file folders and other items to be filed and depending on the file content to stored therein. Also, a width of the lower portion 26 is shown as "X2". The width "X2" can be in a range of 12 to 24 inches and greater depending on the width of the items stored on the file folder rack 10.

The vertical height of the inverted "U" shaped brackets 31 is shown as "X3" and is in a range of 4 to 7 inches. This height is important and must be sufficient to prevent the first file folder or other filed items from falling forward and off the front of the vertical file folder rack 10. Also shown in this drawing is a height "X4" or a distance in a range of 1 to 4 inches between the bottom of the first wire frame 12 and the bottom of the second wire frame 12 staggered and disposed below the first wire frame.

Figure 2:
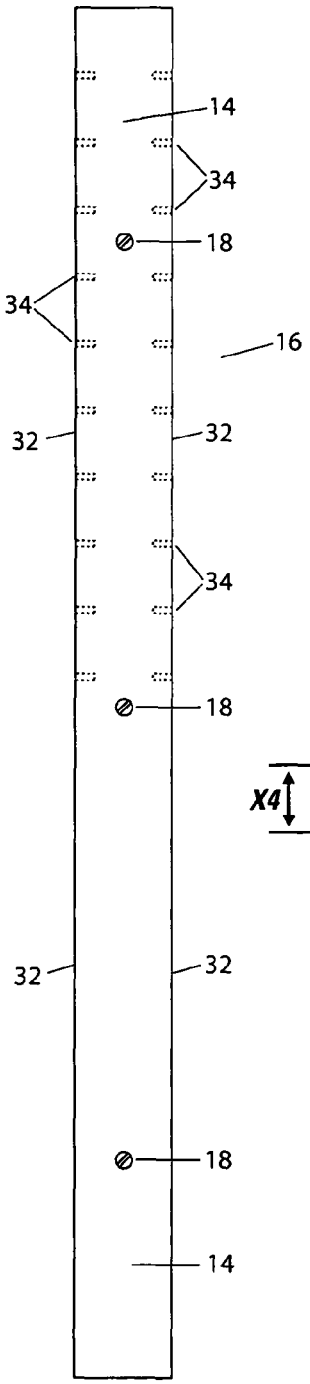
FIG. 2 is a front view of the rectangular elongated wall base mounted on the wall with the wire frames removed from the sides of the wall base.

In FIG. 2, a front view of the rectangular elongated wall base 14 is shown mounted on the wall 12 with the wire frames 12 removed from sides 32 of the wall base. In this drawing, equally spaced pivot holes 34 are shown in the sides 32 of the wall base 14 for receiving inverted "L" shaped opposite ends 36 of the top portion 20 of the wire frames 12. The opposite ends 36 of the top portion 20 are shown in FIGS. 1, 3 and 4.

In FIG. 3, a front view of the file folder rack 10 is shown with a plurality of file folders 38 received on the triangular shaped wire frames 12 and disposed along the length of the wall base 14. In this view, different sizes and shapes of file folders 38 are shown with a bottom 40 of each file folder 38 resting on top of the support arms 28 of each wire frame. It should be noted that by providing a space "X4", shown in FIG. 1, between the lower portions of the wire frames 12 and downwardly along the length of the wall base 14, a bottom front portion 42 of each file folder 38 is exposed for labeling the folder with a folder name or "Label" and quick access to the file. As mentioned above, the vertical space between the lower portion of the first wire frame 12 and the lower portion of the second wire frame 12 and the wire frames under the second wire frame is "X4" and in a range of 1 to 4 inches. This space, as mentioned above, provides enough room for ease in viewing the "Label" at the bottom of each file folder.

In viewing this drawing, it can be seen that the wire frames 12 can received different thickness of file folders 38, with the files resting next to each other along the length of the file folder rack 10. Also, the weight of the wire frames 12 and the weight of the file folders 38, by gravity, hold the frames and file folders vertically and next to each other. As mentioned above, the file folders, posters, drawings, maps and the like can have different width and height ranges X5, X6, X7, and X8. Also, in the drawing a height dimension "X9" is shown and is greater then 4 inches. This height "X9" is greater than the height range "X4" and illustrates an envelope or other smaller in height item that can be filed on the subject file folder rack 10.

In FIG. 4, a side view of the file folder rack 10 with stored file folders 38 is shown. In this drawing, the first, second and third wire frames 12 have been pivoted outwardly, as indicated by arrow 44, for removing the file folder 38 resting on the support arms 28 of the fourth wire frame 12. In this example, the support arms 28 of the third wire frame 12 can be used for lifting the first, second and third wire frames 12 disposed above the file folder 38 on the fourth wire frame 12.

Figure 5:
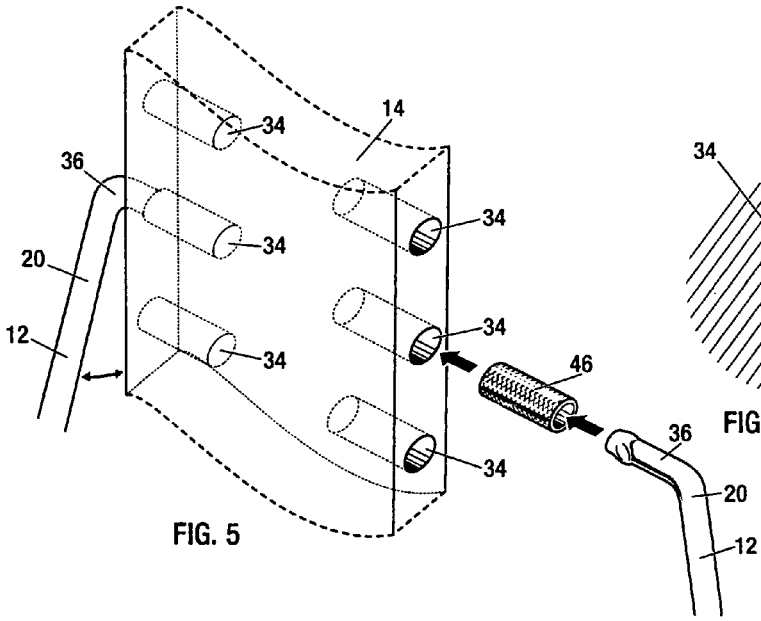
FIG. 5 is a perspective view of a portion of the wall base having holes in the side of and along the length of the wall base for receiving inserts therein. In this example, a top portion of the wire frames are formed into a pair of inverted "L" shaped ends. The ends are received inside the inserts in a press fit.

In FIG. 5, a perspective view of a portion of the wall base 14 is shown with the pivot holes 34 along the length of the wall base for receiving inserts 46 therein. In this drawing, the inverted "L" shaped opposite ends 36 of the top portion 20 of one of the wire frames 12 is positioned for receipt in the inserts 46. The inserts 46 are received in the pivot holes 34 in a press fit.

Figure 6:
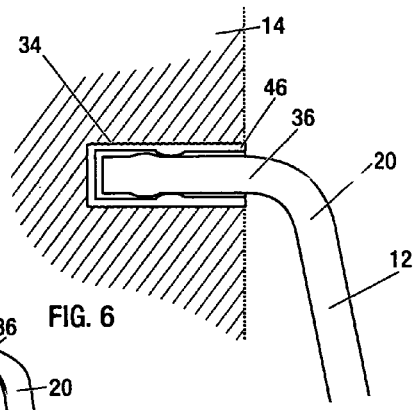
FIG. 6 is a sectional view of a portion of the wall base with an insert received in a hole and an "L" shaped end of the wire frame received therein.

In FIG. 6, a sectional view of a portion of the wall base 14 is shown with the insert 46 received in one of the pivot holes 34 and the inverted "L" shaped end 36 of the wire frame 12 received therein.

Figure 7:
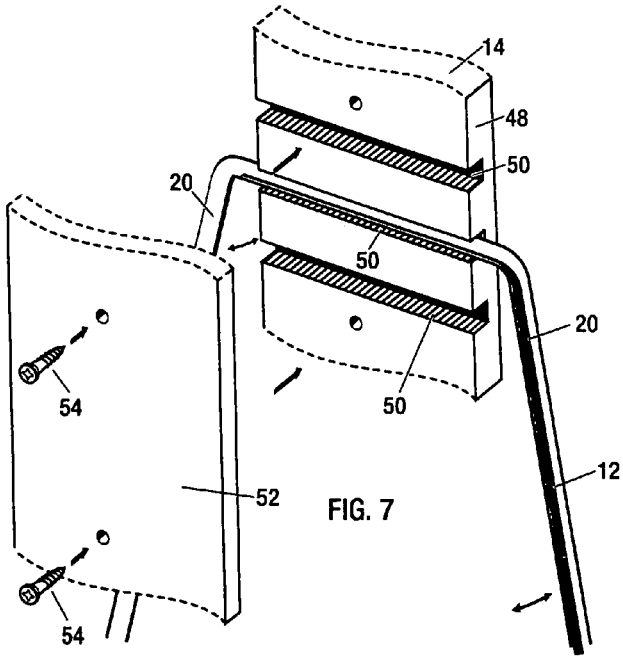
FIG. 7 is a perspective view of a portion of the wall base divided into a back plate with spaced apart horizontal grooves therein and a front cover for receipt over the back plate. A top portion of a triangular shaped wire frame is received in one of the grooves of the back plate.

In FIG. 7, a perspective view of a portion of another embodiment of the wall base 14 is shown. The wall base 14 is divided into a back plate 48 with spaced apart horizontal grooves 50 therein and a front cover 52 for receipt over the back plate 48. The top portion 20 of the wire frames 12, in this example, is continuous and not divided into opposite ends 36, as shown in FIGS. 5 and 6. The top portion 20 is received in the groove 50 of the back plate 48 and pivoted therein. The front cover 52 is shown with screw fasteners 54 for securing it to the front of the back plate 48.

Figure 8:
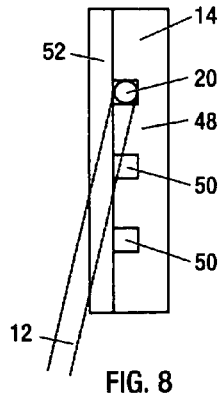
FIG. 8 is a side view of the wall base shown in FIG. 7 with the top portion of the wire frame received in the groove. The front cover is shown attached to the back plate.

In FIG. 8, a side view of the wall base 14 is illustrated as shown in FIG. 7. The top portion 20 of the wire frame 12 is received in the horizontal groove 50. The front cover 52 is shown attached to the back plate 48.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A wall mounted vertical file folder rack adapted for holding a first file folder with a first file folder name or label in a bottom portion thereof and a second file folder with a second file folder name or label in a bottom portion thereof, the file folder rack disposed next to a wall, the file folder rack comprising:

a wall base adapted for mounting on the wall;

a first wire frame, a top portion of the first wire frame pivotally attached along a vertical length of the wall base, a center portion of the first wire frame including a pair of first suspension arms, and a lower portion;

a pair of spaced apart, first file support arms attached to and extending outwardly from the lower portion of the first wire frame, the first file support arms adapted for receiving a bottom of a first file folder thereon;

a first file keeper formed in the lower portion of the first wire frame and attached to and disposed between the first file support arms;

a pair of spaced apart, inverted "U" shaped brackets attached to and extending vertically upward from the first file support arms, the "U" shaped brackets having a vertical height in a range of 4 to 7 inches, the vertical height sufficient to prevent the first file folder from falling forward and off the file folder rack;

a second wire frame, a top portion of the second wire frame pivotally attached along the vertical length of the wall base, a center portion of the second wire frame including a pair of second suspension arms, and a lower portion;

a pair of spaced apart, second file support arms attached to and extending outwardly from the lower portion of the second wire frame, the second file support arms adapted for receiving a bottom of a second file folder thereon;

a second file keeper formed in the lower portion of the second wire frame and attached to and disposed between the second file support arms, the first wire frame disposed on top of the second wire frame and resting thereagainst in a spaced apart, staggered relationship;

a vertical space in a range of 1 to 4 inches between the lower portion of the first and second wire frames, the 1 to 4 inch vertical space sufficient for providing the bottom portion of the second file folder to always be visible for viewing a file folder name, when the first file folder is received on the first wire frame and the second file folder is received on the second wire frame; and a back of the first wire frame adapted for engaging and holding the second file folder in place when the second file folder is received on the second wire frame thereby precluding the need of a pair of inverted "U" shaped brackets on the second file support arms.

2. The file folder rack as described in claim 1 wherein the wall base is an elongated rectangular-shaped wall base.

3. The folder rack as described in claim 1 wherein the wall base includes a plurality of spaced apart pivot holes disposed along opposite vertical sides thereof, the top portion of the first and second wire frames divided into inverted "L" shaped opposite ends, the opposite ends received in the pivot holes.

4. The file folder rack as described in claim 1 wherein the first and second wire frames have a triangular-shaped configuration and a length in a range of 18 to 36 inches for holding file folders, posters, drawings and maps having a height up to 30 inches.

5. A wall mounted vertical file folder rack adapted for holding a first file folder with a first file folder name or label in a bottom portion thereof and a second file folder with a second file folder name or label in a bottom portion thereof, the file folder rack disposed next to a wall, the file folder rack comprising:

an elongated rectangular-shaped wall base adapted for mounting on the wall, the wall base having a plurality of spaced apart, horizontal pivot holes, the pivot holes disposed along vertical and opposite sides of the wall base;

a first wire frame, a top portion of the first wire frame divided into inverted "L" shaped opposite ends, the opposite ends received in two of the horizontal pivots holes in the wall base, a center portion of the first wire frame including a pair of first suspension, arms, and a lower portion;

a pair of spaced apart, first file support arms attached to and extending outwardly from the lower portion of the first wire frame, the first file support arms adapted for receiving a bottom of a first file folder thereon;

an arch-shaped, first file keeper formed in the lower portion of the first wire frame and attached to and disposed between the first file support arms;

a pair of spaced apart, inverted "U" shaped brackets attached to and extending vertically upward from the first file support arms, the "U" shaped brackets having a vertical height in a range of 4 to 7 inches, the vertical height sufficient to prevent the first file folder from falling forward and off the file folder rack;

a second wire frame, a top portion of the second wire frame divided into inverted "L" shaped opposite ends, the opposite ends received in two of the horizontal pivots holes in the wall base, a center portion of the second wire frame including a pair of second suspension arms, and a lower portion;

a pair of spaced apart, second file support arms attached to and extending outwardly from the lower portion of the second wire frame, the second file support arms adapted for receiving a bottom of a second file folder thereon;

an arch-shaped, second file keeper formed in the lower portion of the second wire frame and attached to and disposed between the second file support arms, the first wire frame disposed on top of the second wire frame and resting thereagainst in a spaced apart, staggered relationship;

the first wire frame disposed on top of the second wire frame and having a vertical space in a range of 1 to 4 inches between the lower portion of each of the wire frames, the 1 to 4 inch vertical space sufficient for providing the bottom portion of the second file folder to be visible for viewing a file folder name, when the first file folder is received on the first wire frame and the second file folder is received on the second wire frame; and a back of the first wire frame engaging and holding the second file folder in place when the second file folder is received on the second wire frame thereby precluding the need of a pair of inverted "U" shaped brackets on the second file support arms.

6. The file folder rack as described in claim 5 wherein the first and second wire frames have a triangular-shaped configuration and a length in a range of 18 to 36 inches for holding file folders, posters, drawings and maps having a height up to 30 inches.

7. A wall mounted vertical file folder rack, the file folder rack disposed next to a wall, the file folder rack comprising:

a first file folder, the first file folder having a first file folder name in a bottom portion thereof;

a second file folder, the second file folder having a first file folder name in a bottom portion thereof;

an elongated rectangular-shaped, vertical wall base, the wall base adapted for mounting on the wall, the wall base having a plurality of spaced apart, horizontal, pivot holes, the pivot holes disposed along vertical and opposite sides of the wall base;

a first wire frame, a top portion of the first wire frame divided into inverted "L" shaped opposite ends, the opposite ends received in two of the horizontal pivots holes in the wall base, a center portion of the first wire frame including a pair of first suspension arms, and a lower portion;

a pair of spaced apart, first file support arms attached to and extending outwardly from the lower portion of the first wire frame, the first file support arms adapted for receiving the bottom of the first file folder thereon;

an arch-shaped, first file keeper formed in the lower portion of the first wire frame and attached to and disposed between the first file support arms;

a pair of spaced apart, inverted "U" shaped brackets attached to and extending vertically upward from the first file support arms, the "U" shaped brackets having a vertical height in a range of 4 to 7 inches, the vertical height sufficient to prevent the first file folder from falling forward and off the file folder rack;

a second wire frame, a top portion of the second wire frame divided into inverted "L" shaped opposite ends, the opposite ends received in two of the horizontal pivots holes in the wall base, a center portion of the second wire frame including a pair of second suspension arms, and a lower portion;

a pair of spaced apart, second file support arms attached to and extending outwardly from the lower portion of the second wire frame, the second file support arms adapted for receiving the bottom of the second file folder thereon;

an arch-shaped, second file keeper formed in the lower portion of the second wire frame and attached to and disposed between the second file support arms, the first wire frame disposed on top of the second wire frame and resting thereagainst in a spaced apart, staggered relationship;

the first wire frame disposed on top of the second wire frame having a vertical space in a range of 1 to 4 inches between the lower portion of each of the wire frames, the 1 to 4 inch vertical space sufficient for providing the bottom portion of the second file folder to be visible for viewing the file folder name, when the first file folder is received on the first wire frame and the second file folder is received on the second wire frame; and a back of the first wire frame engaging and holding the second file folder in place when the second file folder is received on the second wire frame thereby precluding the need of a pair of inverted "U" shaped brackets on the second file support arms.

8. The file folder rack as described in claim 7 wherein the first and second wire frames have a triangular-shaped configuration and a length in a range of 18 to 36 inches for holding file folders, posters, drawings and maps having a height up to 30 inches.

* * * * *